United States Patent [19]

Holley

[11] Patent Number: 4,903,611

[45] Date of Patent: Feb. 27, 1990

[54] ANCHOR SPREADER APPARATUS AND METHOD

[75] Inventor: John D. Holley, Montgomery, Ala.

[73] Assignee: Holley Engineering Company, Inc., Montgomery, Ala.

[21] Appl. No.: 320,527

[22] Filed: Mar. 8, 1989

[51] Int. Cl.[4] ..... E01B 29/32

[52] U.S. Cl. ..... 104/307; 104/9; 104/17.2; 29/426.5

[58] Field of Search ..... 104/9, 16, 17.2, 307; 238/327 R

[56] References Cited

U.S. PATENT DOCUMENTS

| | | | |
|---|---|---|---|
| 4,319,392 | 3/1982 | Cutts | 104/307 X |
| 4,722,283 | 2/1988 | Holley | 104/9 |
| 4,809,614 | 3/1989 | Theurer et al. | 104/9 X |

*Primary Examiner*—Andres Kashnikow
*Assistant Examiner*—William Grant
*Attorney, Agent, or Firm*—Kerkam, Stowell, Kondracki & Clarke

[57] ABSTRACT

Rail anchors used to secure rails to ties are spread by pushing on the tie plates immediately adjacent to the anchors. A pair of hydraulic cylinders are disposed upon a common rod and are used to push a tie plate in opposite directions, thereby spreading each of two anchors associated with one side of a particular tie.

20 Claims, 5 Drawing Sheets

ANCHOR SPREADER APPARATUS AND METHOD

BACKGROUND OF THE INVENTION

The present invention relates to the spreading of anchors on a rail of a railroad track.

A railroad track includes two rails which extend along a bed having ballast and railroad ties. The rails are mounted to the ties by tie plates which are spiked to the ties and which restrain the rails against movement perpendicular to the lengthwise direction of the rails. Additionally, the rails are restrained against lengthwise movement relative to ties by the use of anchors. The anchors are metallic pieces which extend from the field side of the rail to the gauge side (i.e., the side in between the two rails). Generally, two anchors are used to capture a rail to a particular tie. Each anchor extends underneath the rail and is disposed either in front of the tie or in back of the tie.

Railroad ties have to be replaced when they have become sufficiently worn. A so-called "tie gang", usually including a number of workers and several machines, will move along a railroad track and replace the worn ties. If a tie is to be replaced, the spikes holding tie plates to the particular tie are removed from the tie. Although this may be done by manual tools, it is more common to use a vehicle which moves along the rails and has a hydraulic mechanism for removing the spikes. After the spikes have been removed from the ties, the spikes are collected, either by machine or manually, so that spikes in sufficiently good condition may be reused. In order to remove a particular tie from under the rails, it is then necessary to spread the anchors from the front end back of the particular tie.

The spreading of the anchors may be done by manual tools. However, a machine has been used for spreading the anchors. A particular known machine clamps the rail and uses a member which directly engages an anchor. A hydraulic cylinder is used to move the member and push the anchor away from the tie by sliding the anchor along the underside of the rail.

The spreading of the anchors allows one to remove ties from under the rails by use of another machine. Machines may be used to replace the worn-out tie with a new tie and to reconstruct that portion of the track.

There have been several problems with known techniques for spreading anchors. Spreading anchors by manual tools is quite labor-intensive and time-consuming. However, the previously-mentioned machine which can be used to move an anchor away from a tie has other problems. Since the member of that machine which engages the anchor generally engages the anchor at a relatively high point, there is a tendency for the anchor to twist. Additionally, the machine operator may have difficulty ensuring that the member properly engages the anchor. This is especially true since there are significant differences between different anchors. A machine which best engages one type of anchor is ill-suited for engaging and spreading another type of anchor.

OBJECTS AND SUMMARY OF THE INVENTION

Accordingly, it is a primary object of the present invention to provide a new and improved anchor spreader apparatus and method.

A more specific object of the present invention is to provide anchor spreading more reliably than previous techniques.

A further object of the present invention is to provide anchor spreading which conveniently spreads both anchors capturing a rail to a particular tie.

A still-further object of the present invention is to provide anchor spreading which avoids or minimizes the tendency of the anchors to twist when the anchors are slid along the bottom of a rail.

The above and other objects of the present invention which will become more apparent as the description proceeds are realized by a method of spreading anchors, on a rail of a railroad track. The apparatus is clamped to the track (i.e. rail, tie, etc.) and the apparatus has a first pusher which is disposed adjacent to a tie plate after the clamping. The tie plate is in turn adjacent to a first anchor and is on top of a tie. The first pusher is then moved generally along the rail in a first direction to engage a first side of the tie plate and push the tie plate against the first anchor such that the first anchor is slid along the rail away from the tie. The apparatus further has a second pusher which is disposed adjacent to the tie plate after the clamping and the tie plate is adjacent to a second anchor. After the moving of the first pusher, the second pusher is moved generally along the rail in a second direction, opposite to the first direction, to engage a second side of the tie plate and push the tie plate against the second anchor such that the second anchor is slid along the rail away from the tie. The moving of the first pusher and the moving of the second pusher are accomplished respectively by first and second hydraulic cylinders mounted to a common rod. The clamping step is performed by clamps on the apparatus clamping opposite sides of the ball of the rail. The apparatus is a vehicle and, before the clamping step, the vehicle is moved until the first pusher is adjacent to the tie plate. The anchor is spread only by way of contact with the tie plate (i.e., no part of the apparatus contacts the anchor).

The method of the present invention may also be described as including the step of moving a vehicle until a first pusher on the vehicle is adjacent to the tie plate. The first pusher is then moved generally along the rail in the first direction to engage a side of the tie plate and push the tie plate against the first anchor such that the first anchor is slid along the rail away from the tie. The vehicle has a second pusher which is disposed adjacent to the tie plate after the moving the vehicle and, after the moving of the first pusher, the second pusher is moved to spread a second anchor away from the tie. The vehicle includes an anchor spreading head and the first pusher is part of the anchor spreading head. Prior to the moving of the first pusher, the method includes lowering of the anchor spreading head. Prior to the moving of the first pusher and after the lowering step, the vehicle is clamped to opposite sides of the ball of the rail. The clamping step is performed by clamps on the anchor spreading head.

The apparatus of the present invention includes a vehicle, a first pusher mounted to the vehicle and operable to engage a tie plate and a first motor means operable to move the first pusher to engage and move a tie plate in a first direction such that the tie plate in turn moves an anchor along the rail in the first direction. The first pusher is one of a pair of first pushers operable to simultaneously engage a tie plate on a gauge side and a field side of a rail. The first pusher is part of an anchor spreading head, and the apparatus includes means to move the anchor spreading head in a vertical direction. Clamps, which are part of the anchor spreading head, are operable to clamp the rail when the pusher is moving a tie plate. A second pusher is mounted to the vehicle and is operable to engage a tie plate and a second motor means is operable to move the second pusher to engage and move a tie plate in a second direction opposite to the first direction such that the tie plate moves an anchor in the second direction. The first and second motor means are first and second hydraulic cylinders mounted for movement along a common rod and the first and second pushers are respectively attached to the first and second hydraulic cylinders.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
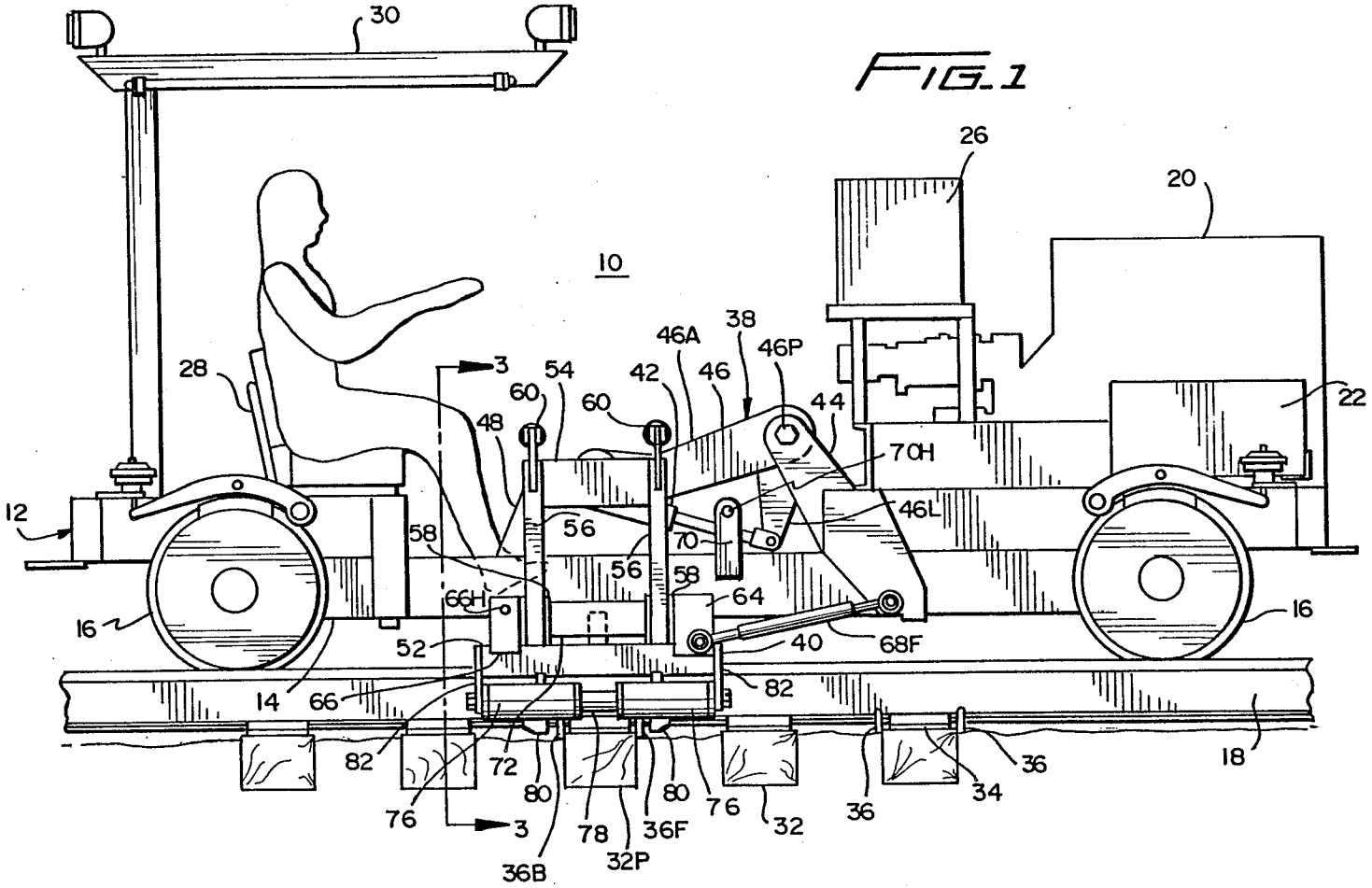
FIG. 1 shows a side view of an apparatus according to the present invention.
Figure 2:
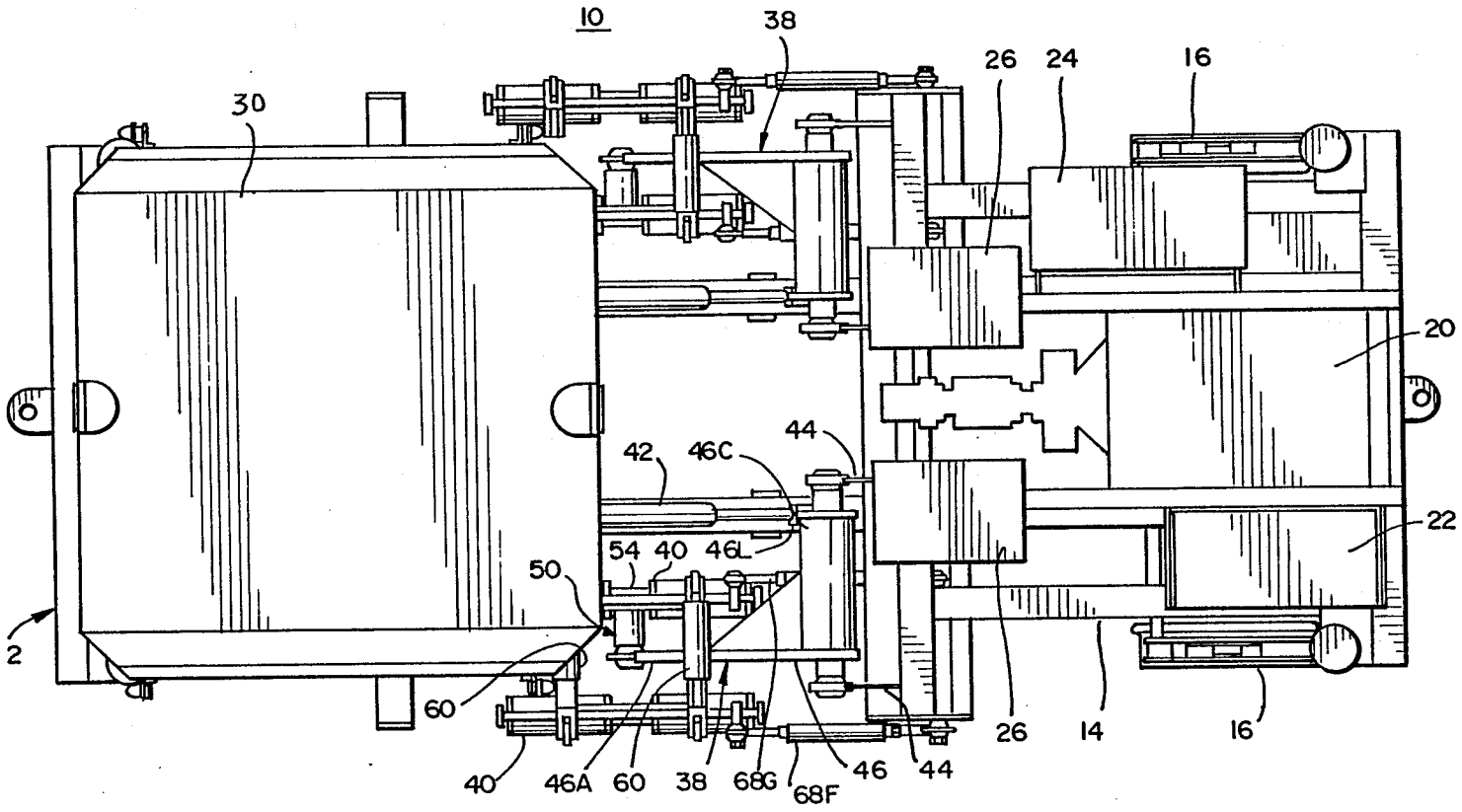
FIG. 2 shows a top view of the apparatus of FIG. 1.

As shown in FIGS. 1 and 2, the apparatus 10, according to the present invention, includes a vehicle 12. The vehicle 12 includes a frame 14 and four wheels 16 for rolling along a pair of rails in known fashion, a single rail 18 being shown in FIG. 1 only. The vehicle may include a power plant 20, fuel tank 22, battery box 24, and a pair of hydraulic tanks 26. An operator seat 28 and a roof 30 are included in the preferred embodiment. A single hydraulic tank could be used instead of two tanks. An accumulator (not shown) would be used in the hydraulic system. An instrument panel and control levers, also not shown, may be mounted on the vehicle. Since these components are not central to the present invention and various known arrangements may be used for propelling and braking the vehicle 12, such features need not be discussed in detail. It should simply be noted that the power plant 20 may be used to provide hydraulic fluid to the mechanisms of the present invention.

The rail 18 is disposed upon a road bed having a plurality of ties 32. Each of the ties includes a tie plate 34 which prevents the rails such as rail 18 from shifting transversely to the lengthwise direction of the rails. Additionally, anchors 36 (only a few being shown and labelled) are used to capture the rail 18 to ties 32. Each anchor 36 is either in front or in back of a corresponding tie and, likewise, would be disposed in front or back of a corresponding one of the tie plates.

In order to remove a particular one of the ties 32, one should move at least one (preferably both) of the anchors 36 away from the tie.

Mounted on each side of the vehicle 12 is an anchor spreading mechanism 38. Since both of the anchor spreading mechanisms 38 are constructed identically, and since FIG. 1 only shows the right side anchor spreading mechanism 38, the discussion which follows will reference components of the right side anchor spreading mechanism. The mechanism 38 includes two anchor spreading heads 40 which are movable vertically by operation of a lift cylinder 42. As with the other cylinders which will be discussed hereafter, the cylinder 42 is preferably a hydraulically operated cylinder. One of the heads 40 is on the gauge side of the rail and the other is on the field side of the rail. The cylinder 42 lifts the gauge side head 40, whereas the field side head 40 (the head 40 lowest in FIG. 2) will be lifted indirectly by a connection to the gauge side head as discussed in more detail with respect to FIG. 3 below.

Attached to frame 14 is a support 44 upon which a lifter assembly 46 is rotatably connected for rotation about an axis extending through point 46P in FIG. 1. The lifter assembly 46 includes a lifter arm 46A, a lower arm 46L, and a connecting cylinder 46C (FIG. 2 only). Arms 46A and 46L and cylinder 46C are welded or otherwise fixed together so as to move as a unit and rotate about the axis corresponding to 46P in FIG. 1. One end of the lift cylinder 42 is pivotally fixed to a lower end of arm 46L (FIG. 1) whereas the opposite end of the lift cylinder 42 is pivotally fixed to a plate 48 which, in turn, is fixed to frame 14. The fixing of the left end of cylinder 42 to the plate or support 48 is not visible in FIG. 1 due to other components. However, it will be readily appreciated that, upon the cylinder 46A extending in length, the lift arm 46A will be generally lowered by pivoting about 46P. Conversely, upon the retraction of cylinder 42, the lift arm 46A will be lifted and this, in turn, will lift the anchor spreading heads 40.

As best shown in FIG. 2, the end of lift arm 46A is pivotally connected to a member 50, which member is in turn connected to the in-board or gauge side head 40 by way of a framework. The framework may best be understood by reference to FIG. 1 for the corresponding framework disposed above the field side head 40 (the framework for the field and gauge heads is essentially identical with minor exceptions noted below). As shown in FIG. 1, the head 40 on the field side includes a lower member 52, an upper member 54, and two vertical members 56. The members 52, 54, and 56 are welded or otherwise fixed together to form a generally rectangular framework to support the head 40.

Figure 3:
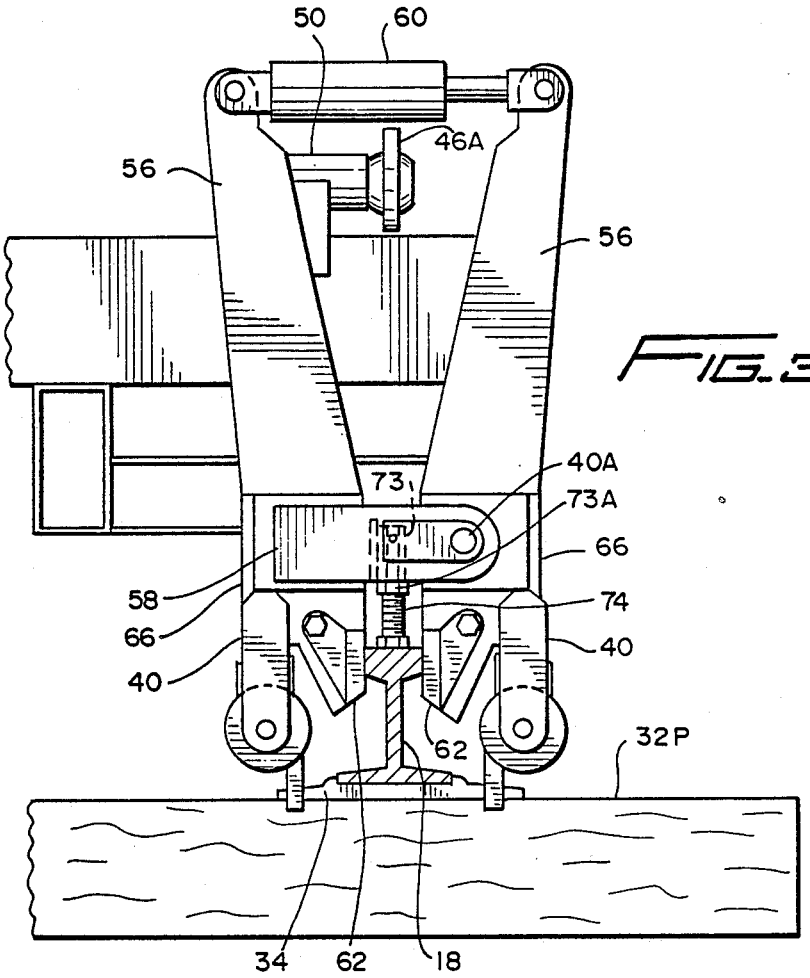
FIG. 3 shows a detailed front view of an anchor spreading head along lines 3—3 of FIG. 1.

Continuing to view FIGS. 1 and 2, but also considering FIG. 3, the relationship of the field side head 40 (right side of FIG 3) and the gauge side head 40 (left side of FIG. 3) will be discussed in more detail. As indicated above, the lift arm 46A will be used to move the heads 40. More specifically, and as best shown in FIG. 3, the lift arm 46A raises and lowers the member 50 which is attached to member 56 by way of member 54 (FIGS. 1 and 2 only). The lifting of the member 56 on the left side of FIG. 3 will cause the gauge side head 40 to be lifted. In order to also affect the right or field side head 40 of FIG. 3, a cross-member 58 is fixed to the left member 56 of FIG. 3 and is pivotally attached to the right member 56 at 40A of FIG. 3. With reference to FIG. 1, there is one of the cross-members 58 for each pair of opposite (opposite side of rail) arms 56. Accordingly, when arm 46A lifts the gauge side head 40, the cross-members 58 in turn lift the field side head 40 and associated framework.

Disposed at the upper ends of members 56 are clamping hydraulic cylinders 60, each cylinder 60 being disposed above a corresponding cross-member 58. By extension of the clamping cylinders 60, the heads move relative to each other such that a pair of opposing clamps or clamp shoes 62 (one pair of shoes for each cylinder 60) will clamp the rail 18 in the manner shown in FIG. 3.

Figure 3A:
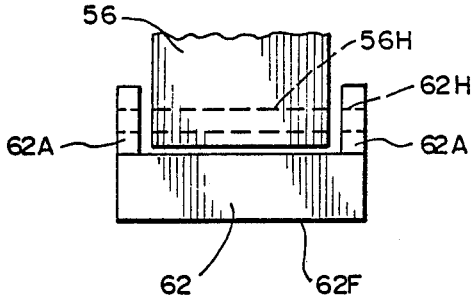
FIG. 3A shows a clamp shoe used with the present invention.

Momentarily referring to FIG. 3A, the clamp shoe 62 has a clamping face 62F for engaging the ball of the rail and has two arms 62A extending for bolting to arm 56 by placement of a bolt (not shown) through the holes 62H and 56H. The clamp shoes are made of mild steel and this arrangement allows them to be replaced easily.

Mounted at opposite sides of the member 52 are plates 64 and 66. Plate 64 is pivotally connected to a field side head lower pitch control link 68F, which link has an opposite end pivotally connected to the frame 14. The link 68F, together with similar gauge side link 68G, help maintain the head 40 in a proper orientation when it is lowered to an operational position. The links 68F and 68G and arm 46A are part of a pantograph such that pivoting of arm 46A about 46P does not change the orientation of heads 40. The link 68G is fixed in length, whereas the link 68F is adjustable in length. By making slight adjustments in the length of link 68F, one ensures that clamping shoes 62 do not grip the rail unevenly. (Uneven gripping might otherwise cause the machine to derail.) The link 68F may be a known type of adjustable link such as one using a threaded connection for length adjustment. The plate 66 includes a hole 66H which may be used to connect the link 68F when the spreading mechanism 38 including the heads 40 is on the opposite side of the machine. When the heads 40 have moved upwardly sufficiently by operation of the lift cylinders 42, the hole 70H of mount 70 which is fixed, to the vehicle frame 14 will be disposed on the opposite side of arm 46L and a locking pin, bolt or other member can be in hole 70H to secure the mechanism 38 in an upper or inoperative position for travel.

Extending between the members 58 is a member 72 (FIG. 1) having a vertical adjustment bolt 74 (FIG. 3) disposed in a sleeve 73 welded to member 72. The bolt 74 be screwed further into the sleeve or unscrewed partially in order to change the operational height of the heads 40. As shown in FIG. 3, the bolt 74 will rest upon the rail 18 when the mechanism is about to spread anchors in a manner described below. Generally, the bolt 74 may be set and need not be readjusted unless the conditions have changed significantly. Jamb nut 73A locks bolt 73 in place.

With reference now primarily to FIGS. 1 and 3, each head 40 includes two hydraulic cylinders 76 mounted to a common rod 78. The cylinders 76 each include a pusher 80, which is preferably an ear extending out from the cylinder. A rod 78 extends below and parallel to the member 52 and is fixed thereto by members 82.

The operation of the present invention may now be discussed. The vehicle 12 is moved along the rails 18 and is slowed to a coast before the right pusher 80 (FIG. 1) is in front of a particular tie such as tie 32P in FIG. 1. The human operator activates a hydraulic valve (not shown) such that hydraulic cylinders 42 cause the heads 40 to be lowered. The right pusher 80 may slide over top of the tie plate and the left pusher 80 (FIG. 1) stops the machine when it contacts the left side of the tie plate on tie 32P. (The machine may alternately be stopped shortly before the left pusher 80 contacts the tie plate.) The heads 40 lower until the bolt 74 rests upon the top of the rail (see FIG. 3). At that stage, the operator activates another hydraulic valve (not shown) which causes extension of the clamping cylinders 60 (see especially FIGS. 2 and 3). This causes the opposing clamp shoes 62 to clamp to the ball of the rail as shown in FIG. 3.

Figure 5:
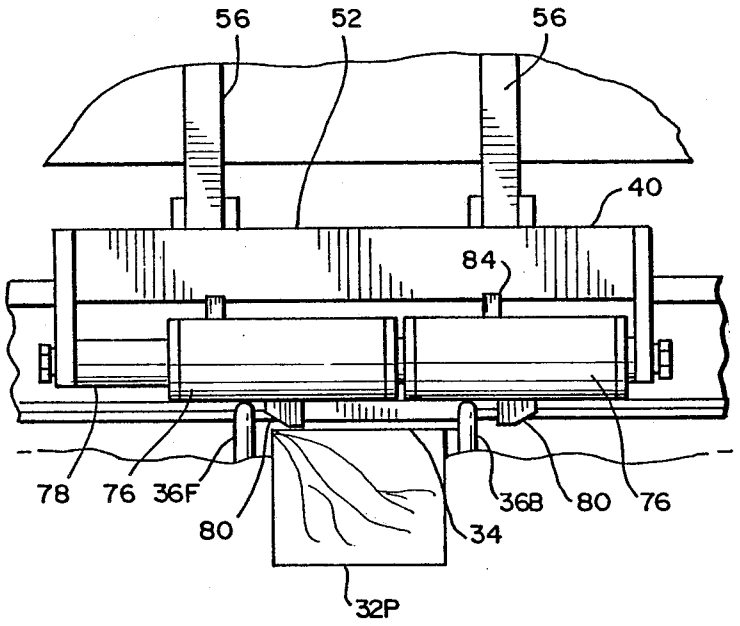
FIGS. 4 and 5 are detailed side views showing the spreading of anchors according to the present invention with some parts deleted for ease of illustration and from an opposite side from the view of FIG. 1.
Figure 4:
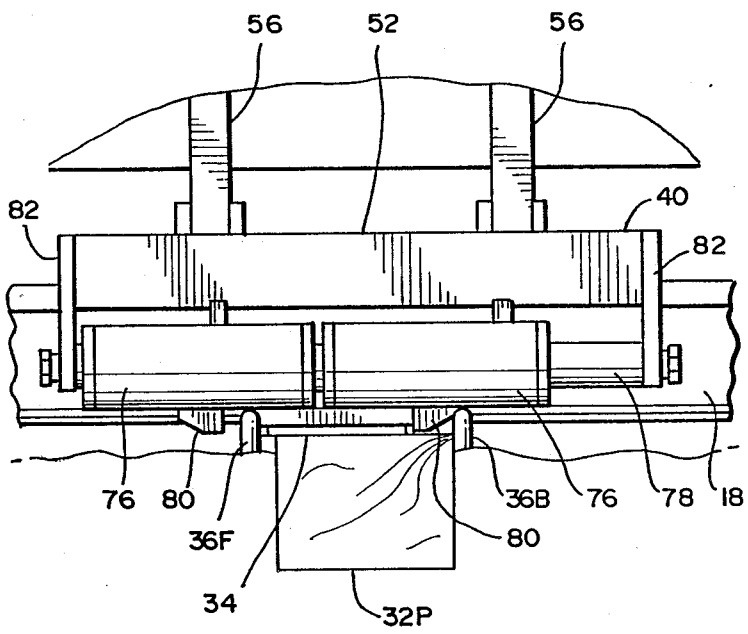

At that stage, the mechanism is ready for actually spreading the anchors and this process is best shown by reference to FIGS. 4 and 5 wherein some portions of the head 40 have been deleted for ease of illustration. Initially, the cylinders 76 are spaced apart, each cylinder 76 being adjacent to one of the members 82. In order to move anchor 36B, the human operator activates another hydraulic control valve (not shown) which causes the front cylinder 76 to move backward (i.e., left in FIGS. 4 and 5 which are views of the opposite side of the vehicle from the view of FIG. 1) to the position shown in FIG. 4. As the cylinder 76 moves, it engages the tie plate 34 and pushes the tie plate partially off the tie 32P. The tie plate in turn pushes the anchor 36F away from the tie 32P as shown in FIG. 4. The spreading of anchor 36F from tie 32P would be greater than illustrated if the operator had used the pusher 80 to stop the vehicle in the manner discussed above. The hydraulic cylinder 76 pushes the anchor 36F by way of the pusher 80 pushing the tie plate 34, which in turn pushes the anchor 36B. It should be noted that FIG. 4 only shows the field side operation. At the same time as the illustrated right cylinder 76 is pushing the tie plate 34, that same tie plate would be pushed in the same direction by a gauge side cylinder. Advantageously, the tie plate 34 is pushed in a straight line and without twisting and, likewise, the anchor 36B is pushed straight along the rail 18. Advantageously, the tie plate 34 is pushing the anchor 36B at a sufficiently low point that any tendency of the anchor 36B to twist about a horizontal axis is avoided or minimized. Most advantageously, difficulties in gripping the anchor are avoided by using the tie plate 34 to push the anchor.

Once the anchor 36F has been spread or spaced from the tie 32P, the human operator changes the hydraulic valve such that the left cylinder 76 is moved backward (towards the right in FIGS. 4 and 5) and the right cylinder 76 is moved to the position shown in FIG. 5. The left cylinder 76 now serves as a motor means for causing the left pusher 80 to push the tie plate 34 against the anchor 36F and cause the front anchor 36B to move away from the tie 32P. The anchors have thus been spread.

It should be noted that various generally known hydraulic valving arrangements could be used to control the various hydraulic cylinders. As the specifics of the hydraulic valving arrangements and circuits are not central to the present invention, they need not be discussed in detail. However, it may be briefly noted that the operator could use a separate stick or lever control for each of the three operations. A first stick or lever could be used to lower the heads and raise the heads, whereas a second lever could be used to cause the clamping and, after completion of the spreading, the unclamping. A third lever could be used to actually control the spreading itself. There would be three levers for each side of the vehicle. As the vehicle nears the proper position, the first lever is pushed forward by the human operator, causing the cylinder 42 to drop the heads. The second lever is then pushed forward after the vehicle stops by the back pushers 80 contacting tie plates and this extends clamp cylinders 60 to cause clamping of the rail. The operator then pushes the third lever forward to cause the back cylinders 76 to move forward and spread the front anchor and then pulls back on the third lever which causes the front cylinders 76 to move back (the back cylinders would be floating at that point) and spread the back anchors by way of the tie plate. The back cylinders would also be pushed back by the tie plate. The operator may then pull back on the first and second lever which simultaneously retracts cylinder 42 to lift the heads 40, retracts cylinders 60 to unclamp and spreads the cylinders 76 by way of the first lever. The hydraulic circuits may be arranged with restricters such that the simultaneous pull back of the first and second levers supplies high pressure first to lift cylinder 42 and more slowly supplies the fluid to operate cylinders 60 and 76. An operator can use his right hand to control three levers for the right mechanism 38 and use his left hand to control three levers for the left mechanism 38. The third or spread lever could have a neutral position (to which the lever automatically returns upon release) and two opposing positions.

Various arrangements could be used to ensure that the cylinders 76 do not rotate relative to the rod 78. In particular, it is necessary that the ear or pusher 80 maintain the proper orientation. One arrangement might use an upper ear 84 (see FIG. 5) to prevent the cylinder 76 from rotating in one direction and a corresponding second upper ear (not visible) to prevent the cylinder 76 from rotating in the other direction, the pair of upper ears being captured on opposite sides of the member 52.

Figure 6:
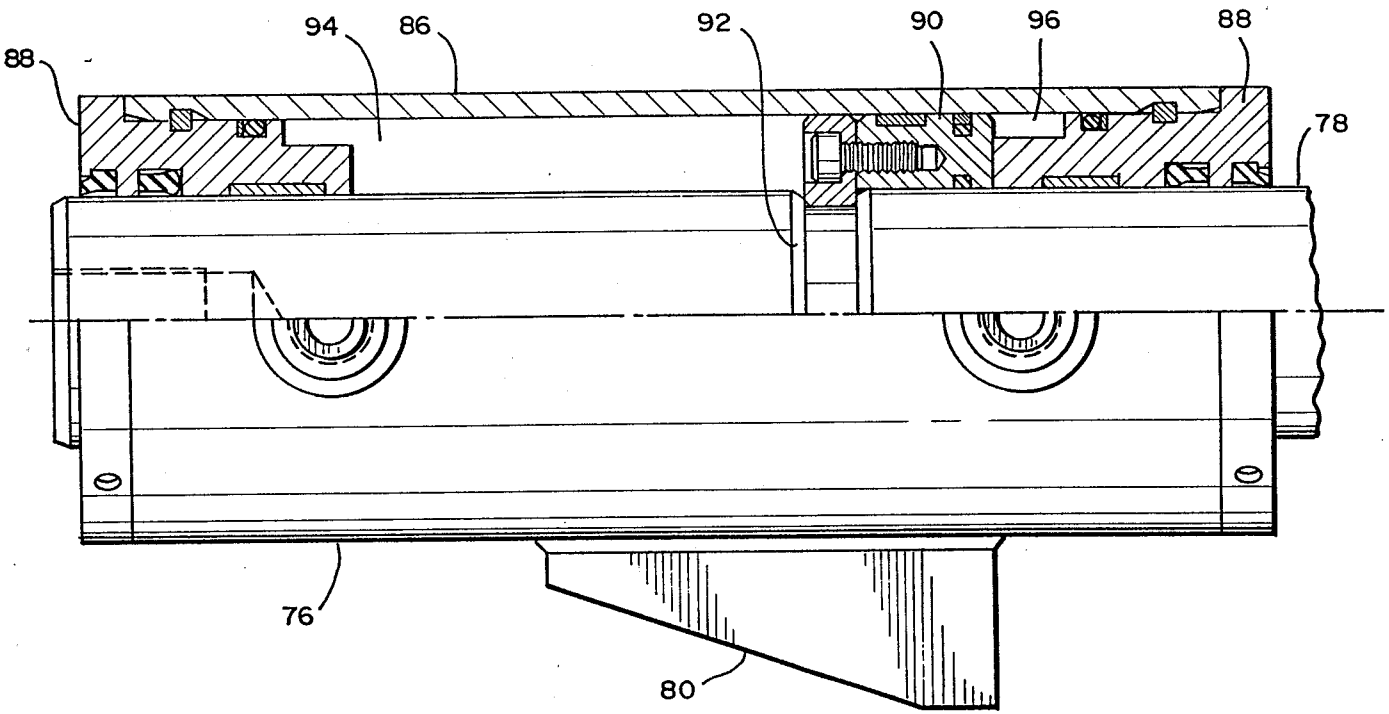
FIG. 6 shows a side view, with portions in cross-section, of a hydraulic cylinder as used with the present invention.

With reference now to FIG. 6, an internal view of one of the identically constructed double-acting hydraulic cylinders 76 is shown. The hydraulic cylinder 76 includes a barrel 86 and two end caps 88 fixed to the barrel at opposite ends thereof. Fixed to the rod 78 is a stop 90 having a portion secured to a depression 92 extending around the rod 78. Various seals are shown and may be used to allow the hydraulic cylinder 76 to operate with hydraulic fluid. The hydraulic cylinder 76 includes two chambers 94 and 96. When hydraulic fluid is supplied to chamber 94, the barrel 86 and pusher 80 are moved leftward in FIG. 6. When hydraulic fluid is removed from chamber 94 and supplied to chamber 96, the barrel 86 moves to the right in FIG. 6 until the end cap 88 is now in contact with the stop 90.

Although various specific constructions and details have been described herein, it is to be understood that these are for illustrative purposes only. Various modifications and adaptations will be apparent to those of skill in the art. Accordingly, the scope of the present invention should be determined by reference to the claims appended hereto.

What is claimed is:

1. A method of spreading anchors on a rail of a railroad track comprising the steps of:

clamping an apparatus to the track, the apparatus having a first pusher which is disposed adjacent to a tie plate after the clamping, which tie plate is in turn adjacent to a first anchor and is on top of a tie; and moving the first pusher generally along the rail in a first direction to engage a first side of said tie plate and push said tie plate against said first anchor such that said first anchor is slid along the rail away from the tie.

2. The method of claim 1 wherein the apparatus has a second pusher which is disposed adjacent to said tie plate after the clamping, and the tie plate is adjacent to a second anchor; and further including the step of, after the moving of the first pusher, moving the second pusher generally along the rail in a second direction, opposite to said first direction, to engage a second side of said tie plate and push said tie plate against said second anchor such that said second anchor is slid along the rail away from the tie.

3. The method of claim 2 wherein the moving of the first pusher and the moving of the second pusher are accomplished respectively by first and second hydraulic cylinders mounted to a common rod.

4. The method of claim 1 wherein the clamping step is performed by clamps on the apparatus clamping opposite sides of the ball of the rail.

5. The method of claim 1 wherein the apparatus is a vehicle and, before the clamping step, the vehicle is moved until the first pusher is adjacent to said tie plate.

6. The method of claim 1 wherein the anchor is spread only by way of contact with the tie plate.

7. A method of spreading anchors on a rail of a railroad track comprising the steps of:

moving a vehicle until a first pusher on the vehicle is adjacent to a tie plate, which tie plate is in turn adjacent to a first anchor and is on top of a tie; and moving the first pusher generally along the rail in a first direction to engage a side of said tie plate and push said tie plate against said first anchor such that said first anchor is slid along the rail away from the tie.

8. The method of claim 7 wherein the vehicle has a second pusher which is disposed adjacent to said tie plate after the moving of the vehicle, and the tie plate is adjacent to a second anchor; and further including the step of, after the moving of the first pusher, moving the second pusher generally along the rail in a second direction, opposite to said first direction, to engage a second side of said tie plate and push said tie plate against said second anchor such that said second anchor is slid along the rail away from the tie.

9. The method of claim 8 wherein the moving of the first pusher and the moving of the second pusher are accomplished respectively by first and second hydraulic cylinders mounted to a common rod.

10. The method of claim 7 wherein the vehicle includes an anchor spreading head, said first pusher being a part of said anchor spreading head, and further comprising the step of, prior to said moving of said first pusher, lowering said anchor spreading head.

11. The method of claim 10 further comprising the step of, prior to said moving of said first pusher and after said lowering step, clamping the rail to said vehicle.

12. The method of claim 11 wherein said vehicle is clamped to opposite sides of the ball of the rail.

13. The method of claim 11 wherein said clamping step is performed by clamps on the anchor spreading head.

14. The method of claim 11 wherein the anchor is spread only by way of contact with the tie plate.

15. Apparatus for spreading anchors mounted to a rail of a railroad track comprising:

a vehicle;

a first pusher mounted to the vehicle and operable to engage a tie plate; and a first motor means operable to move said first pusher to engage and move a tie plate in a first direction such that the tie plate in turn moves an anchor along the rail in the first direction.

16. The apparatus of claim 15 wherein said first pusher is one of a pair of first pushers operable to simultaneously engage a tie plate on a gauge and a field side of a rail.

17. The apparatus of claim 15 wherein said first pusher is part of an anchor spreading head, and further including means to move said anchor spreading head in a vertical direction.

18. The apparatus of claim 15 further comprising clamps operable to clamp said rail when said pusher is moving a tie plate.

19. The apparatus of claim 15 further comprising a second pusher mounted to the vehicle and operable to engage a tie plate and a second motor means operable to move said second pusher to engage and move a tie plate in a second direction, opposite to said first direction, such that the tie plate moves an anchor in the second direction.

20. The apparatus of claim 19 wherein said first and second motor means are first and second hydraulic cylinders mounted for movement along a common rod and said first and second pushers are respectively attached to said first and second hydraulic cylinders.

* * * * *